US006154685A

United States Patent [19]

Kim

[11] Patent Number: 6,154,685

[45] Date of Patent: Nov. 28, 2000

[54] CONTROL APPARATUS AND METHOD FOR MOTOR VEHICLE PARKING SYSTEM

[75] Inventor: Sung Joon Kim, Pusan, Rep. of Korea

[73] Assignee: LG Industrial Systems Co., Ltd., Seoul, Rep. of Korea

[21] Appl. No.: 09/056,877

[22] Filed: Apr. 8, 1998

[30] Foreign Application Priority Data

Apr. 8, 1997 [KR] Rep. of Korea ..... 97-12810

[51] Int. Cl.[7] ..... G06F 7/00

[52] U.S. Cl. ..... 700/217; 414/252

[58] Field of Search ..... 700/217, 214; 414/252

[56] References Cited

U.S. PATENT DOCUMENTS

| | | | |
|---|---|---|---|
| 3,390,791 | 7/1968 | Baldwin et al. | 414/252 |
| 3,984,012 | 10/1976 | Ennis et al. | 214/16.1 |
| 4,310,890 | 1/1982 | Trehn et al. | 364/467 |
| 4,547,844 | 10/1985 | Adams | 364/189 |
| 5,018,926 | 5/1991 | Sternad | 414/253 |
| 5,024,571 | 6/1991 | Shahar et al. | 414/231 |
| 5,113,349 | 5/1992 | Nakamura et al. | 364/478 |
| 5,238,348 | 8/1993 | Reimer | 414/252 |
| 5,351,187 | 9/1994 | Hassett | 364/401 |
| 5,751,973 | 5/1998 | Hassett | 395/213 |

*Primary Examiner*—Christopher P. Ellis
*Assistant Examiner*—Khoi H. Tran
*Attorney, Agent, or Firm*—Birch, Stewart, Kolasch & Birch, LLP

[57] ABSTRACT

A control apparatus and method for motor vehicle parking system capable of resuming an automatic parking operation when a power failure is recovered by the backup of the previous operation status data required for the automatic parking operation, thereby reducing the time spent in a stand-by condition for storing or retrieving a motor vehicle. The control apparatus for the parking system includes a plurality of vertically and laterally moving pallets, a driving section for driving the pallets, and a control section. The control section includes a manipulation section for selecting a pallet number, an operation status detector for detecting the operation status of the pallets, a controller having first and second memories for storing the pallet number data from the manipulation section, and the pallet operation status data from the operation status detector and for outputting drive signals for driving the vertically and laterally moving pallets so that a vertically moving pallet moves up or down without collision with the laterally moving pallets, a DC power supply for supplying to the controller a DC power and a backup battery for supplying a backup power to the controller when a normal power supply is cut off.

18 Claims, 11 Drawing Sheets

CONTROL APPARATUS AND METHOD FOR MOTOR VEHICLE PARKING SYSTEM

BACKGROUND OF THE INVENTION

1. Field of the Invention

The present invention relates in general to a motor vehicle parking system capable of automatically recovering to perform parking operation which was stopped by a power failure, and more particularly to a control apparatus and method for a vertically and laterally moving type motor vehicle parking system by which the system automatically recovers its parking operations when power is restored after a failure with a capability of recalling information indicative of the previous parking operation executed before the power failure.

2. Description of the Related Art

A conventional vertically and laterally moving type motor vehicle parking facility is illustrated in FIG. 1. As shown in FIG. 1, the conventional motor vehicle parking facility comprises a plurality of lifting pallets 2*c*–2*e* whose reference positions are on the second level column, a plurality of laterally moving pallets 2*a*, 2*b* whose total number is at least 1 less than the number of the lifting pallets 2*c*–2*e* and whose reference positions are on the ground-level floor, a plurality of limit switches 3*a*–3*c*, 4*a*–4*c* installed on the top and bottom of the lifting pallets 2*c*–2*e* for detecting the operating state of the respective pallets 2*c*–2*e*, a plurality of limit switches 7*a*, 7*b* installed on the bottom of the laterally moving pallets 2*a*, 2*b* for detecting the operating state of the respective pallets 2*a*, 2*b*, an over-lifting, detecting switch 6 installed on the ceiling of the parking facility for detecting the over-lifting of the lifting pallets 2*c*–2*e* and outputting a detected signal to a control unit to stop a driving motor when the over-lifting is detected, and the control unit (not shown in FIG. 1) for controlling the operation of the respective pallets in accordance with detected signals inputted from the above-described switches, and a manipulation unit (also not shown in FIG. 1) for entering data required to operate the system.

The operation of the conventional parking facility as constructed above will be explained with reference to the FIGS. 2A to 2C and 3.

Referring to FIG. 2A to 2C, assume that a system operator wishes to retrieve a motor vehicle laded on the pallets 2*c*–2*e*. First referring to FIG. 2A, supposing the vehicle is loaded on the pallet 2*c*, the directs unit controls the pallets 2*a* and 2*b* on the ground-level floor to move to the right, so that a space is provided for moving the pallet 2*c* down to the ground-level floor. Referring if, the system operator wishes to retrieve the motor vehicle loaded on the pallet 2*d*, the directs unit controls pallets 2*a* and 2*b* to move left and right respectively, as shown in FIG. 2B. Similarly, if the vehicle is on the pallet 2*c*, the unit controls the pallets 2*a* and 2*b* to move left.

However, the conventional parking system has the drawback in that it cannot resume its automatic parking operation after a recovery form a power failure, because the positional information of the respective pallets 2*a*–2*c* is lost when the power failure occurs. The system cannot accomplish its automatic parking operation until all the pallets are in their reference positions. Accordingly, the conventional parking system may not resume its automatic parking operation after recovery from a power failure until the system operator manually moves the pallets to their reference positions as shown in FIG. 1 using an automatic/manual operation selection switch.

Referring now to FIG. 3, the operation of the conventional parking system is described when a power failure occurs. First, the power is supplied to the system (step S1), and the system operator manually surveys the parking facility to determine whether or not any safety related problems exist in the system (step S2). If safety related problems do not exist in the system, the system operator or the vehicle driver turns on a safety confirmation button (step S3) and then manipulates the system to call the respective pallet (step S4). The plurality of the pallets thereafter moves under the control of the system (step S5). If the power failure occurs and is later recovered (step S5), the system operator or the vehicle driver sets the system with a manual operation mode by manipulating an automatic/manual operation mode selection switch (step S6). The plurality of the pallets not at their reference positions are then manually moved to their reference positions by the system operator or the vehicle driver (step S7). Thereafter, a check is made to determine whether or not all pallets are in their reference positions. If so, the automatic parking operation is resumed (step S9). Otherwise, it returns to the step S7. If any safety related problems exist at step S2, the system is set to operate in emergency operation mode (step S10).

An automatic/manual operation mode selection switch, a brake means in a pallet driving motor, and a lever for locking/releasing the brake means are provided to perform step S7. In order to laterally move the pallets not at their reference positions, the system operator or the vehicle driver positions the lever to release the brake, and pushes the laterally moving pallets to a desired position. Also, the lifting pallets can be moved down to the ground-level floor by its own weight or can be moved up by rotating a handle connected to a driving shaft of the motor.

The conventional motor vehicle parking system has the disadvantage that it is inconvenient to use when a power failure occurs. The conventional parking system is designed to automatically move the pallets to store or retrieve a motor vehicle, however, the information required for the automatic operation of the system lost when a power failure occurs. Thus, the system operator or the vehicle driver must manually move the pallets to their reference positions to restart the automatic parking operation. Therefore, after the recovery from the power failure is recovered, the conventional motor vehicle system causes inconvenience in use and requires large time consumption.

SUMMARY OF THE INVENTION

An object of the present invention is to overcome the problems involved in the related art, and to provide a control apparatus and method for a motor vehicle parking system which can resume an automatic parking operation a recovery from a power failure is recovered by storing information related to the pallets operation status and by comparing the information stored with the present operation status of the pallets after recovery.

In one aspect of the present invention, there is provided a control apparatus for a motor vehicle parking system having a plurality of laterally moving pallets located on a ground-level floor, a plurality of lifting pallets located on an upper level column and whose number is at least 1 more than the number of the laterally moving pallets, driving means installed on each of the pallets for supplying a driving force to move the pallets, and control means for controlling the driving means, the control apparatus comprising operation status backup means for storing both data indicative of the number of the lifting pallet called by the control means during the automatic parking operation and data indicative of the operation status of the pallets, caused by an operation of the lifting pallet, automatic parking resuming means for resuming the automatic parking operation by detecting the data indicative of a current operation status of the system when a power is restored and by comparing between the data stored in the backup storing means and the current operation status data.

In another aspect of the present invention, there is provided a control apparatus for a motor vehicle parking system having a plurality of laterally moving pallets located on a ground-level floor, a plurality of lifting pallets located on an upper level column and whose number is at least 1 more than the number of the laterally moving pallets, driving means installed on each of the pallets for supplying a driving force to move the pallets, and control means for controlling the driving means, the control apparatus comprising: manipulation means having pallet number selection means for selecting the number of the lifting pallet to be called for storage or retrieval, and outputting the corresponding pallet number signal when the pallet number is selected through the pallet number selection means; operation status detecting means installed on the lifting pallets and on the laterally moving pallets for detecting the operation status of the pallets to output a detected signal; control means having a first memory means for storing pallet number data defined by the pallet number signal inputted from the manipulation means and a second memory mean for storing pallet operation status data defined by the pallet operation status signal inputted from the operation status detecting means, the control means outputting both a first drive signal for driving the lifting pallet corresponding to the pallet number signal to move the lifting pallet up or down and a second drive signal for driving the laterally moving pallets to provide a space for the lifting pallet to move down without a colliding with the laterally moving pallet to the driving means of the lifting pallet assigned by the pallet number signal and to the driving means of the laterally moving pallets, respectively; a direct current power supply means for supplying to the control means a direct current power source which is converted from an alternating current power source, and backup battery means connected to the normal alternating current power source for charging itself up with the direct current power source converted from the alternating current power supply, and for supplying a backup power source to the control means when a normal power failure occurs.

In still another object of the present invention, there is provided a control method for a motor vehicle parking system having a plurality of laterally moving pallets located on a ground-level floor and a plurality of lifting pallets located on an upper level column, the method comprising steps of: (a) storing a backup information data related to a system operation such as the pallet number of the called lifting pallet and an operation status (mode number) caused by an operation of the called lifting pallet; and (b) resuming an automatic parking operation if the current condition meets the requirement to resume the automatic parking operation as a result of comparing the stored operation status data with the current operation status data of the system when a power failure is recovered.

BRIEF DESCRIPTION OF THE DRAWINGS

The above object and other advantages of the present invention will become more apparent by describing in detail the preferred embodiments thereof with reference to the attached drawings, in which.

DETAILED DESCRIPTION OF THE PREFERRED EMBODIMENTS

The control apparatus and method for a motor vehicle parking system according to the embodiments of the present invention will now be described with reference to the accompanying drawings.

Figure 1:
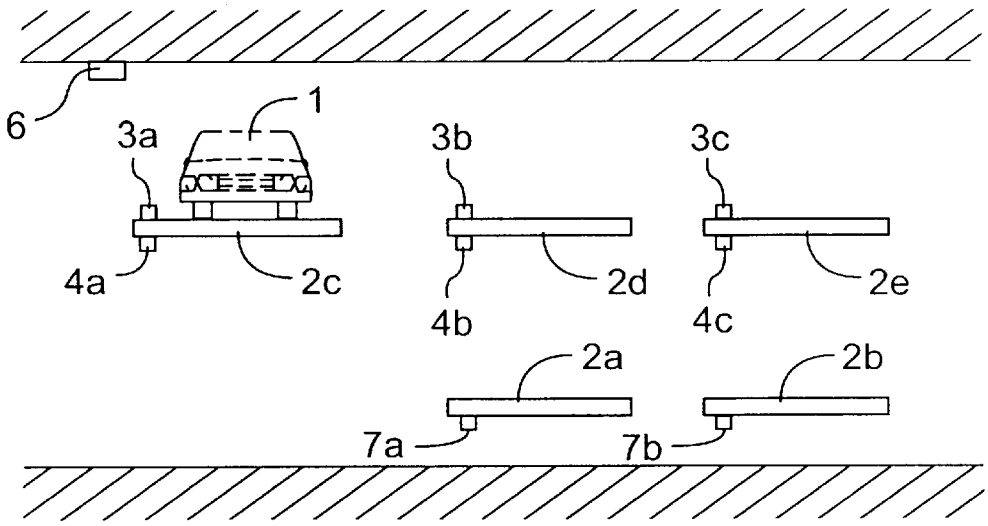
FIG. 1 CONVENTIONAL ART
FIG. 1 is a schematic diagram illustrating the pallets of a conventional vertically and laterally moving type parking system.
Figure 4:
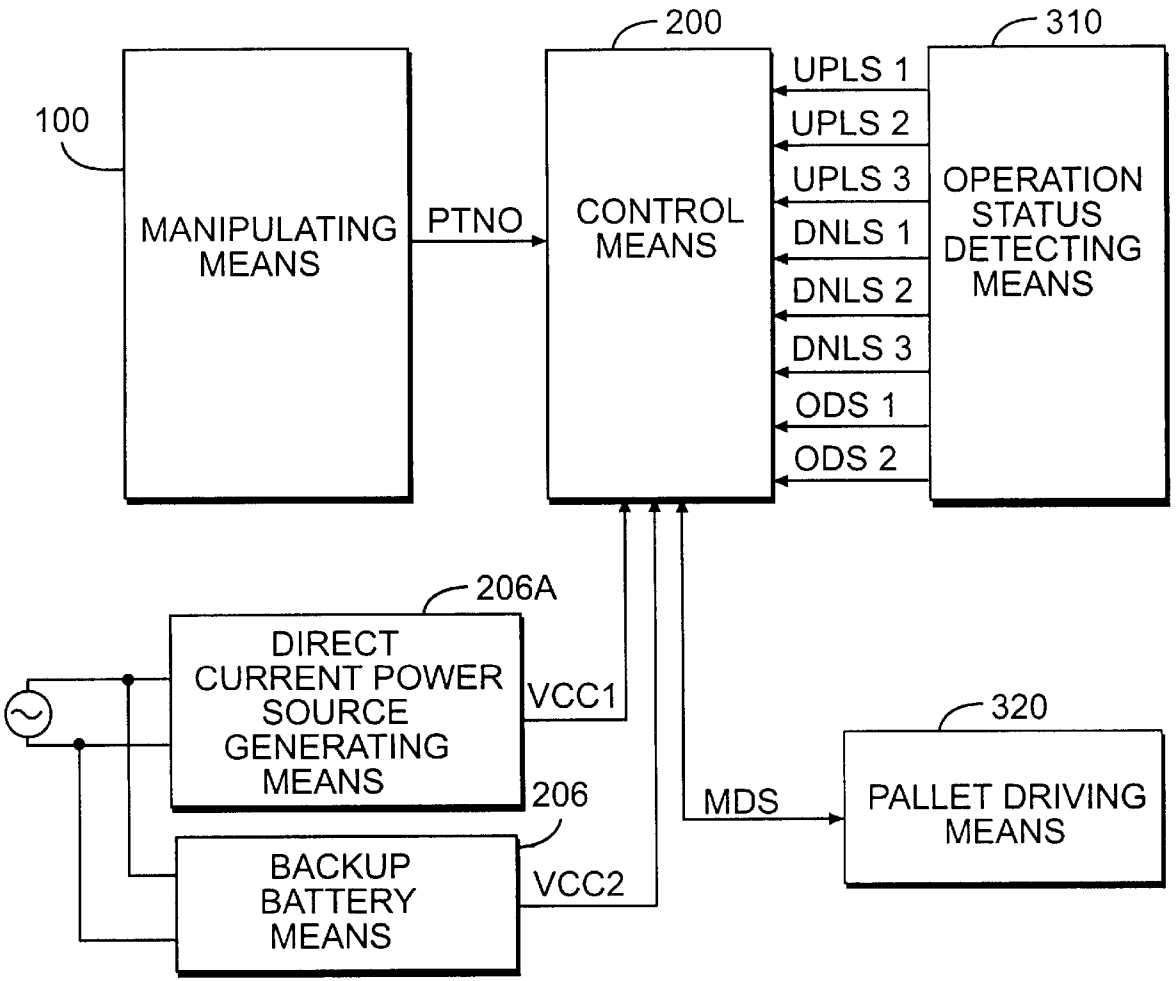
FIG. 4 is a block diagram the vertically and laterally moving type parking system according to an embodiment of the present invention.

Referring to FIG. 4, the parking system according to an embodiment of the present invention comprises a plurality of laterally moving pallets (not shown in FIG. 4) located on a ground-level floor for each storing a motor vehicle; a plurality of lifting pallets (also not shown) located on an upper level column each storing a motor vehicle, whose number is at least 1 more than the number of the laterally moving pallets; pallet driving means 320 installed on each of the pallets supplying a driving force to move the pallets; manipulation means 100 including pallet call input means making the system operator or the vehicle driver call a respective pallet and outputting a corresponding signal indicative of a selected the pallet number (Hereinafter, referred to as PTNO) (for example, the pallets are increasingly numbered in a clockwise manner from the pallet 2*b*: the pallet 2*b* is numbered 1, the pallet 2*a*; 2, the pallet 2*c*; 3, the pallet 2*d*; 4, the pallet 2*e*; 5); operation status detecting means 310 detecting the position of each of the pallets and outputting corresponding output signals UPLS1, UPLS2, UPLS3, DNLS1, DNLS2, DNLS3, ODS1, and ODS2; means (not shown) for determining/outputting a respective data indicative of a respective pallet position related operation status mode (there are 8 modes from a mode 0 to a mode 7 in the preferred embodiment.) upon receipt of the PTNO and a signal indicative of a corresponding position of the pallet; control means 200 including two separate memory means for respectively storing information indicative of the number of the pallet and the pallet position related mode of each pallet and transmitting a driving signal (Hereinafter referred to as a MDS) moving pallets to prevent the pallets from colliding with each other; a direct current (DC) power supply 206A converting an alternating current (AC) power source into a DC power source and supplying the DC power source VCC1 of a certain level to the control means; backup battery means 206 connected to the AC power source for recharging with the DC power source converted from the AC power source during a normal power supply, and supplying the power source VCC2 to the control means when the power supply is cut off. The signal UPLS1–UPLS3 are generated from the limit switches 3*a*–3*c* installed on the top of the lifting pallets 2*c*–2*e*, and those signals are ON when the pallet is in its reference position, and are OFF otherwise, for example, when the pallet is moving down or the pallet is on the ground-level floor. The signals, DNLS1–DNLS3 are generated from the limit switches 4*a*–4*c* installed on the bottom of the lifting pallets 2*c*–2*e*, and those signals are ON when the lifting pallet is on the ground-level floor, and are OFF otherwise such as when the pallet is moving up or in its reference position. Further, the signals, ODS1, ODS2 are generated from the limit switches 7*a*, 7*b* installed on the bottom of the laterally moving pallets 2*a*, 2*b*, and those signals are ON when the pallets 2*a*, 2*b* are their reference positions as shown in FIG. 1, and are OFF otherwise.

Figure 5:
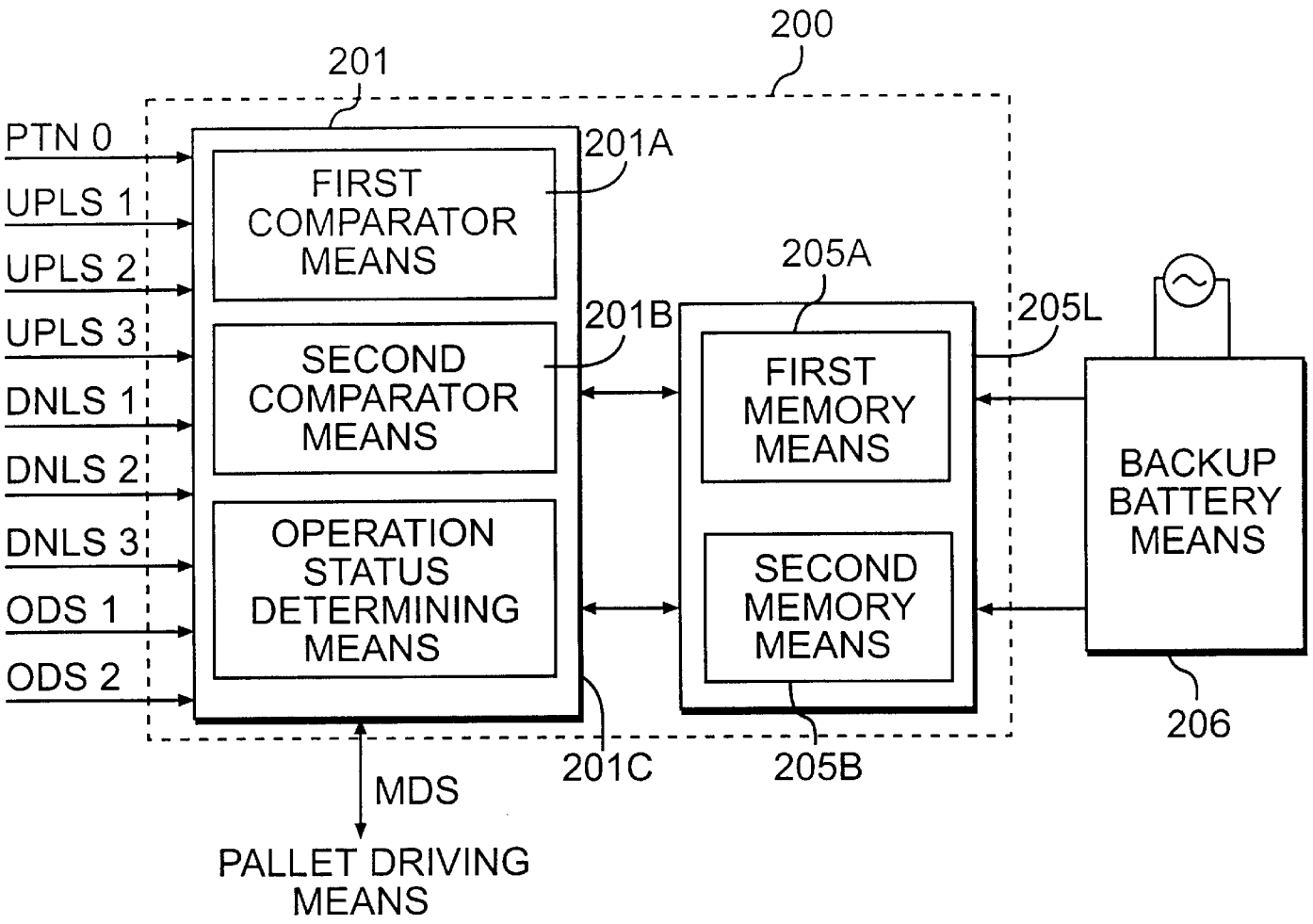
FIG. 5 is a schematic circuit diagram of the control means of FIG. 4 which is connected to the backup battery means.

Referring now to FIG. 5, the control means 200 shown in FIG. 4 comprises memory means 205L such as a RAM for separately storing the data (Hereinafter, referred to as CD) indicative of the number of the pallet upon receipt of PTNO signal and the data indicative of the pallet operation status (Hereinafter, referred to as a Mode) upon receipt of UPLS1-ODS2, and for keeping those data therein because the power is supplied from the backup battery means even though the power failure is occurred; and a central processing unit 201 for reading out the previously stored data indicative of the pallet number and of the pallet operation status form the memory means, for making comparison between the data values stored in the memory means and data values indicative of the current position of the respective the pallets, and for transmitting the pallet drive signal when the compared values are equal to each other.

The memory means 205L further comprises a first memory means 205A for storing the backup data indicative of the pallet number CD defined by the called the pallet number (Hereinafter, referred to as PdCD), PTNO; and a second memory means 205B for storing the backup data PdMode indicative of the pallet operation status according to the pallet position detection signal UPLS1-ODS2. The memory means 205L can be implemented of one memory instead of two because addresses of the memory can be divided into two areas. The central processing unit 201 further comprises a first comparing means 201A for reading the PdCD data stored in the first memory 205A and comparing the backup data PdCD with a first data indicative of the lifting pallet identification number which is an effective value allocated to each pallet installed in the parking system by a programmer when a power failure is recovered resulting in that the power is supplied to the control means not from the backup battery means 206 but from the direct current power source 206A; and a mode selection means 201C for determining the pallet operation mode.

Figure 6:
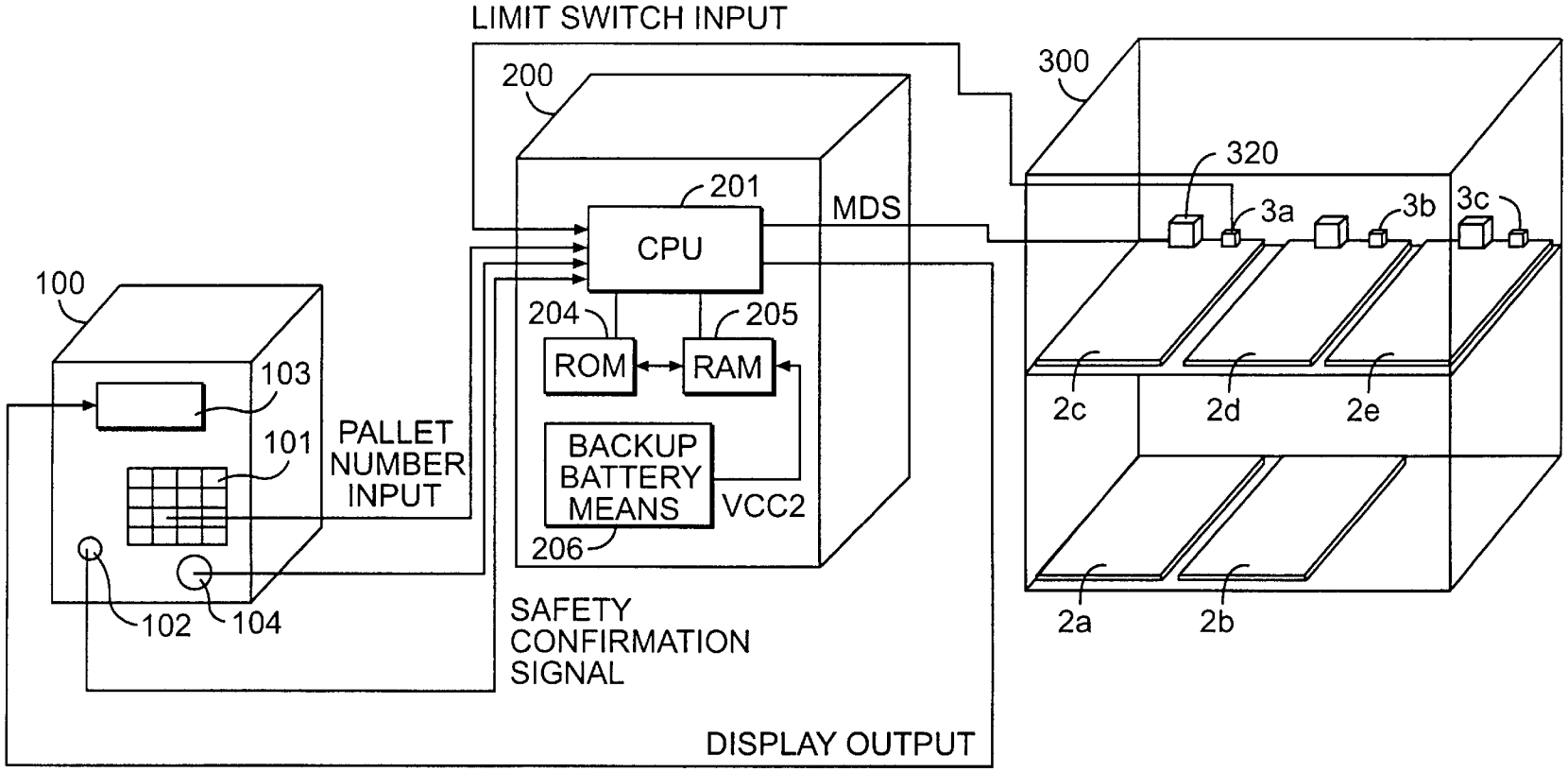
FIG. 6 is a schematic perspective view of the vertically and laterally moving type parking system of FIG. 4.

Referring now to FIG. 6, the parking system according to the embodiment of the present invention comprises a manipulation unit 100, a control means 200, and a parking facility 300. The manipulation unit 100 includes a manipulation panel 101 for entering a data such as a pallet number, a display window 103 for displaying information, a safety confirmation switch 102 for transmitting a safety confirmation signal when the system operator or the vehicle driver presses it down, and an automatic/manual operation selection switch 104 for selecting one of a manual operation mode and an automatic operation mode. The control means 200 comprises a CPU 201 having a RAM 205 for storing the data with the power supplied from the backup battery means to maintain data even when the power failure occurs and a ROM 204 for storing a program for executing a series of parking operations, for generating the pallet drive signal; a backup battery means 206 for supplying the power to the RAM when the power failure occurs. The parking facility 300 comprises a plurality of the pallets 2*a*–2*e*, a pallet position notifying means 3*a*–3*c*, and a plurality of the pallet driving means 320.

Figure 7:
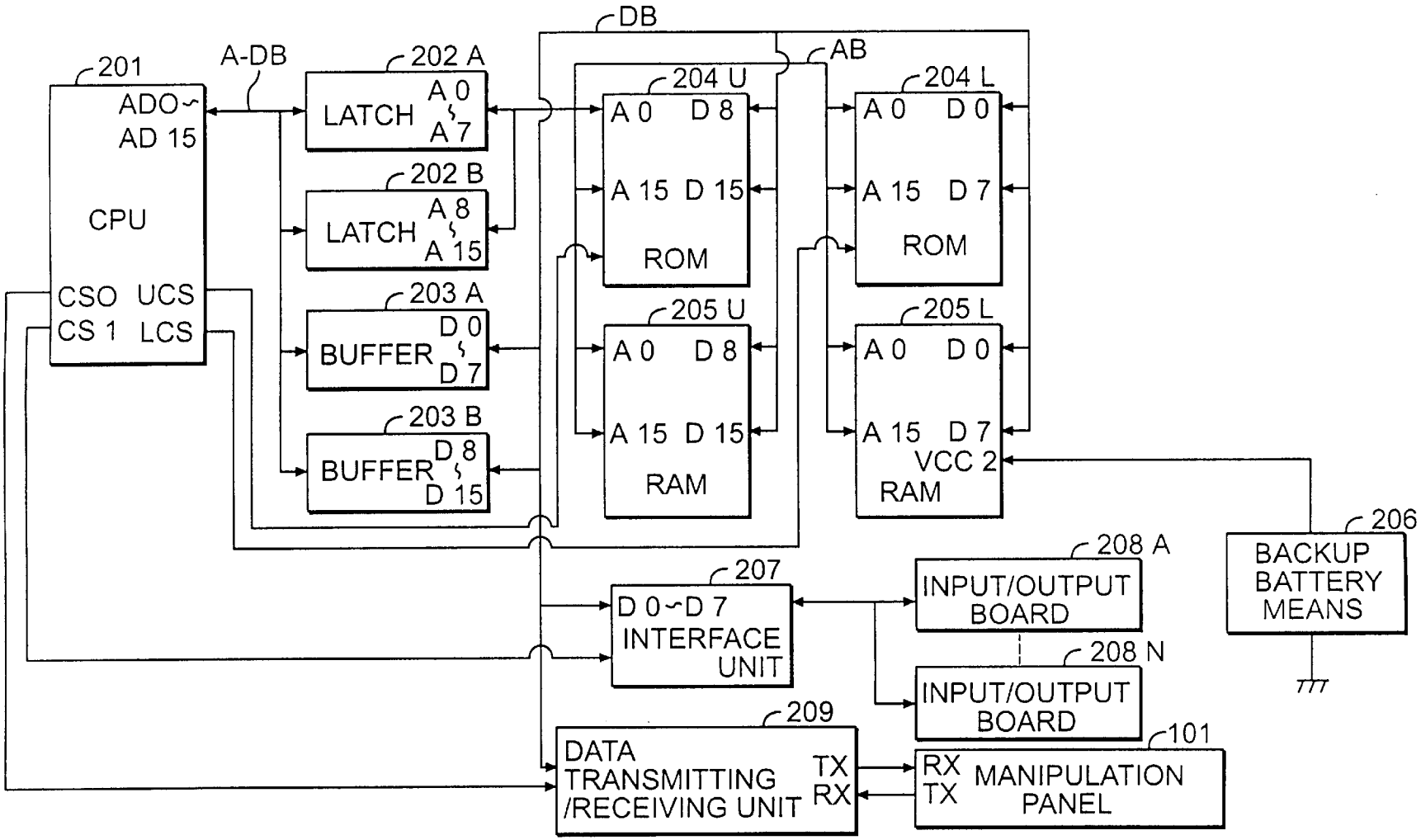
FIG. 7 is a schematic circuit diagram of the control apparatus in which the control means is connected to its peripheral devices for an automatic operation of the pallets.

Referring now to FIG. 7, the control means of the control device according to an embodiment of the present invention is shown in more detail. The control means comprises a CPU 201 for controlling data to be stored and for controlling to resume the automatic parking operation when a power failure is recovered; ROMs, an upper level ROM 204U and a lower level ROM 204L for storing a program performing the automatic parking operation; an upper level RAM 205U selected with an upper chip selection signal UCS for storing data; a lower level RAM 205L connected to the backup battery means 206 selected with the lower chip selection signal LCS for storing data generated at the CPU when the power failure occurs; a backup battery means 206 for charging up with a DC power converted from an AC power in normal operation and supplying the stand-by power VCC2 to the lower level RAM 205L when the power supply from the AC power is cut off; data transmitting/receiving unit 209 activated with an external port selection signal CS0 for transmitting/receiving data between the manipulation panel 101 and the CPU 201 upon receipt of signals from the pallet position notifying switches; an interface unit 207 for interfacing data exchange between the control means and a plurality of input/output boards 208A–208N activated upon receipt of an external port selection signal CS1 for data exchange between the CPU and various the pallet position notifying switches installed on the pallets, and for supporting the plurality of input/output boards; and latches 202A, 202B for supporting data/address transmission between the CPU and ROMs, RAMs using a transmission lines ADB and AB, DB respectively.

Figure 8:
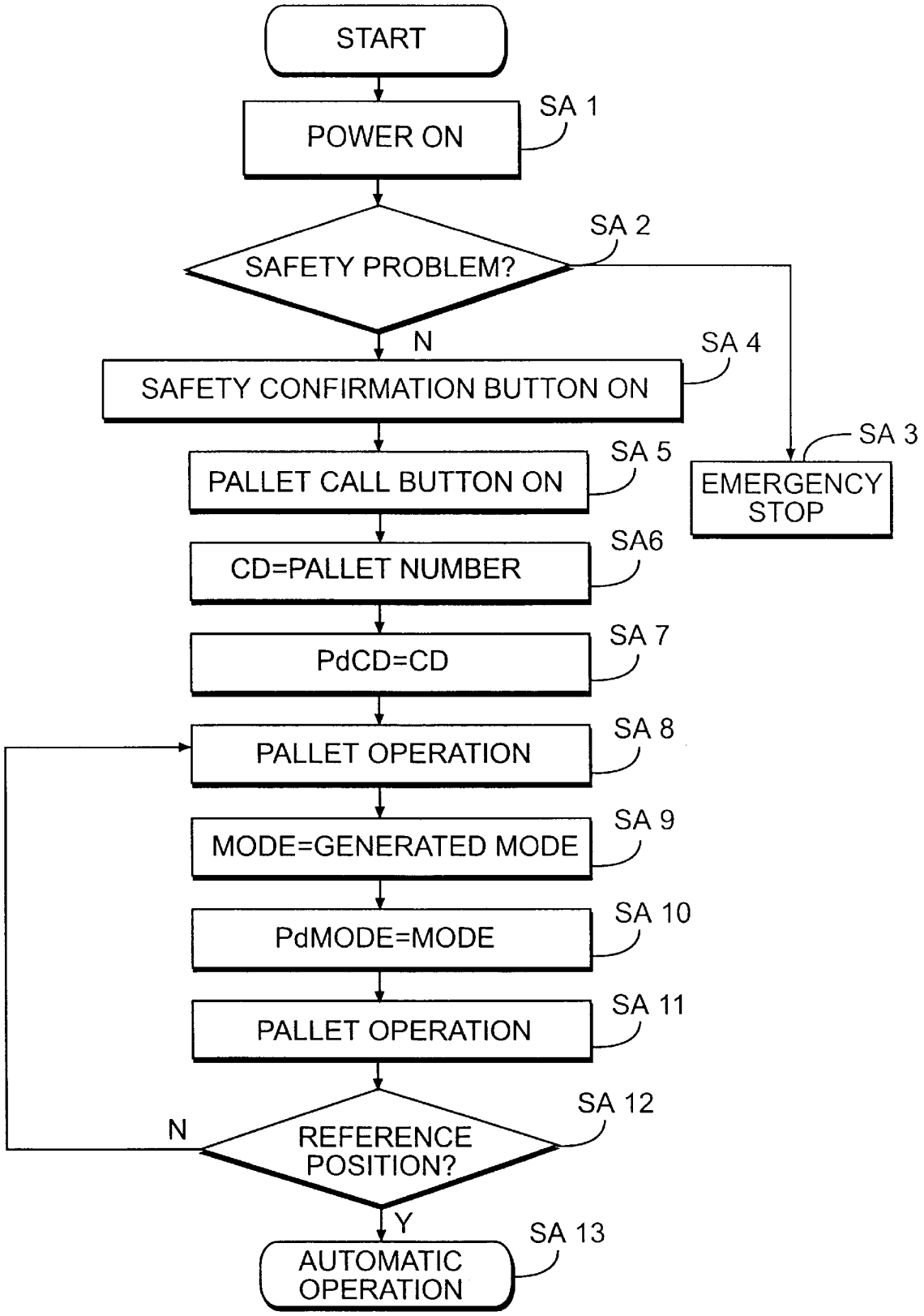
FIG. 8 is a flowchart explaining an automatic parking operation of the control apparatus according to the embodiment of the present invention in a normal power supply condition.

Referring now to FIG. 8, the operation of the control device according to the present invention in a normal power supply condition will be explained. The automatic parking operation includes the steps of:

(a) generating/storing a backup data PdCD in a certain address of the lower level RAM 205L upon receipt of CD defined by the pallet call signal PTNO generated when the system operator or the vehicle driver presses the pallet call button to call a respective pallet, if the system operator or the vehicle driver calls one of the plurality of the pallets when no safety related problem exists in a normal power supply condition (SA1–SA7), and (b) resuming an automatic parking operation so as to store or retrieve a motor vehicle from a pallet when the pallet is determined to be in a reference position by generating/storing a backup data PdMode in another address of the lower level RAM 205L using the information indicative of the pallet operation status (i.e., generated mode number: mode) provided when an activation of the pallet called in step (a) to shift (SA8–SA13).

Figure 9:
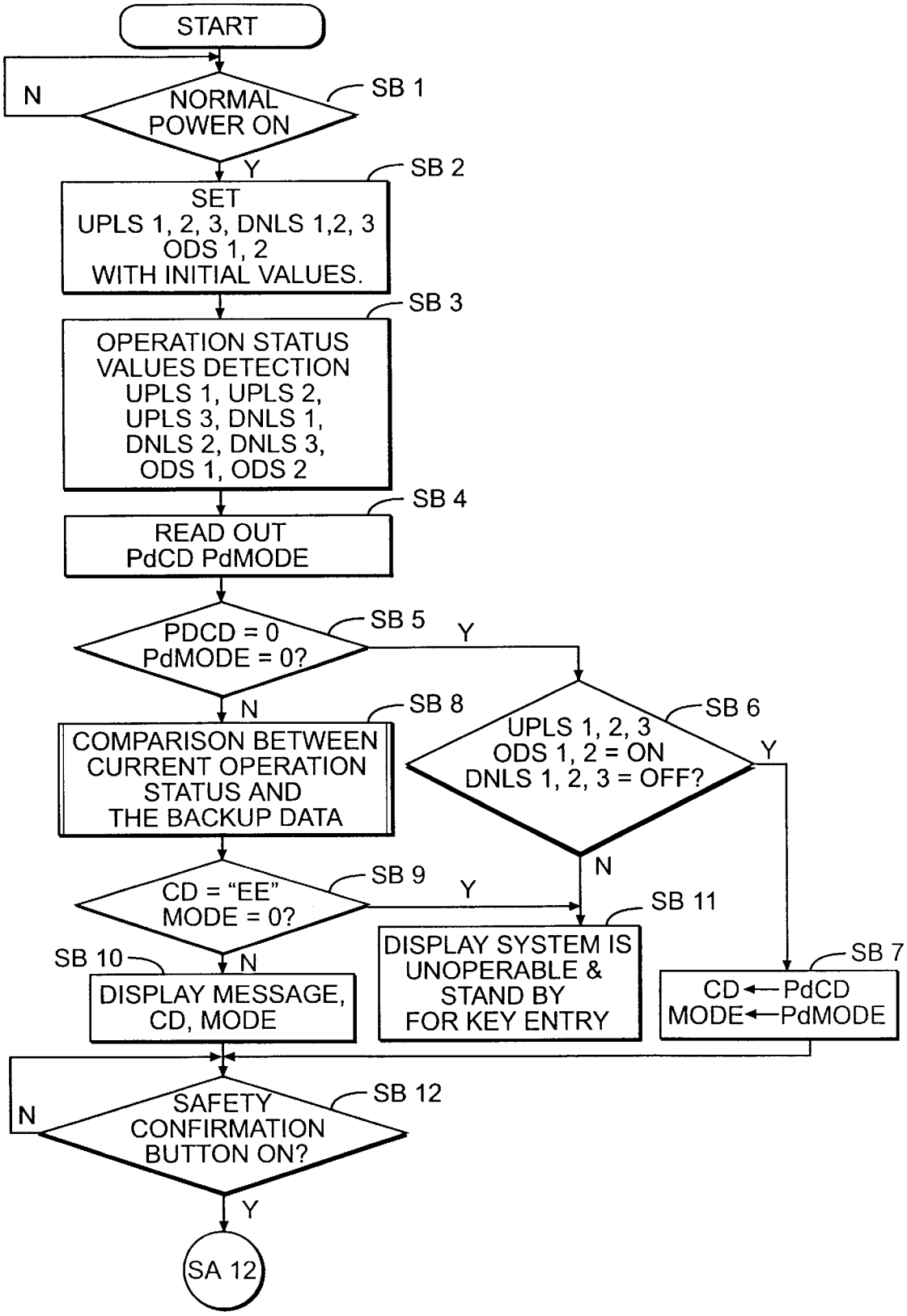
FIG. 9 is a flowchart explaining the resuming of the automatic parking operation performed by the control device according to the embodiment of the present invention when the power is restored.

Referring now to FIG. 9, the operation of continuously resuming the automatic parking function according to the embodiment of the present invention will be explained. The resuming operation when a power failure is recovered includes the steps of:

(a) recovering the moving operation stopped at the power failure moment of the pallets by detecting both data such as PdCD, PdMode from the memory means and incoming data indicative of the pallet position transmitted from the pallet position notifying switches after erasing all the pallet operation status data when a normal power is supplied because of power failure recovery (SB1–SB4);

(b) controlling to instruct an automatic parking operation upon receipt of the safety confirmation signal from the safety confirmation switch while displaying the pallet number as well as the pallet operation status if the pallet operation status data is identical to the recovered data as a result of comparison between them, if otherwise, generating an error signal to control the system not operable (SB5–SB12).

Figure 10:
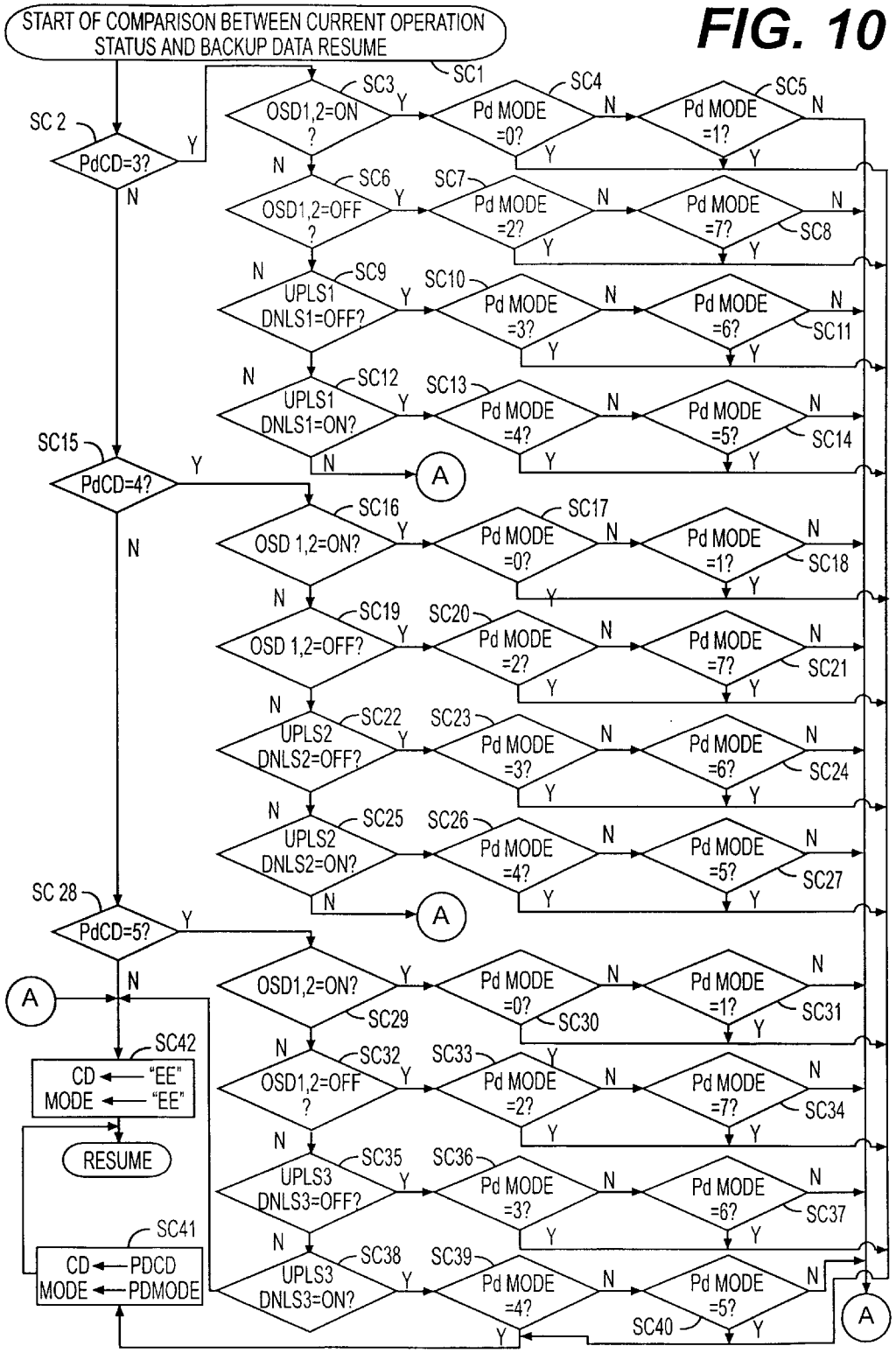
FIG. 10 is a flowchart explaining in detail the comparison of the current status data with the backup data at step SB8 in FIG. 9.

Referring now to FIG. 10, the Step SB8 of comparing the current status data with the backup data, in FIG. 9 is described in detail. The detection of whether or not the data indicative of the current status of the pallet is equal to the backup data is performed in such a manner that the first comparator means 201A performs its function to compare the data indicative of the pallet number retrieved from the first memory means 205A with the predetermined pallet identification number set by a programmer (In the figure, it is explained for the case of the lifting pallets 2*a*, 2*b*, and 2*c*, It is also shown that the pallet identification number of the pallets 2*a*, 2*b*, 2*c* are 3, 4, 5 respectively.), and sequentially a second comparator means 201B performs its function to compare the data stored in the second memory 205B with the signals related to the pallet position UPLS1-ODS2 transmitted from the pallet operation detecting means 310. In case that each of the lifting pallets is selected by the first comparator means 201A (SC2, SC15, SC28), the second comparator means 201B detects the case that the stored data indicative of the pallet operation status is 0 or 1 (when determined YES in steps of SC4, SC5, SC17, SC18, SC30, SC31) when the signals ODS1, ODS2 transmitted by the limit switches are ON (when determined YES in steps of SC3, SC16, and SC29), the case that the stored data indicative of the pallet operation status is 2 or 7 (when determined YES in steps of SC7, SC8, SC20, SC21, SC33, SC34) when the signals ODS1, ODS2 transmitted by the limit switches are OFF (when determined YES in steps of SC6, SC19, and SC32), the case that the stored data indicative of the pallet operation status are 3 or 6 (when determined YES in steps of SC10, SC11, SC23, SC24, SC36, SC37) when each of the signals (UPLS1 and DNLS1; or UPLS2 and DNLS2; or UPLS3 and DNLS3 for each of vertically moving pallet respectively ) transmitted from the limit switch and a pallet position notifying switch both installed at each of the lifting pallets are OFF (when determined YES at the steps of SC9, SC22, SC35), and the case that the stored data indicative of the pallet operation status are 4 or 5 (when determined YES in steps of SC13, SC14, SC26, SC27, SC39, SC40) when each of the signals (UPLS1 and DNLS1; or UPLS2 and DNLS2; or UPLS3 and DNLS3 for each of the lifting pallets) are OFF and ON respectively (when determined YES in steps of SC12, SC25, SC38), and determines those detected cases as cases in which the incoming data indicative of the current operation status is equal to the backup data. Then the step SC41 is performed to recover the stored backup data. Except those cases, the error signal is generated in Step of SC42 so that the system becomes not operable.

Figure 11:
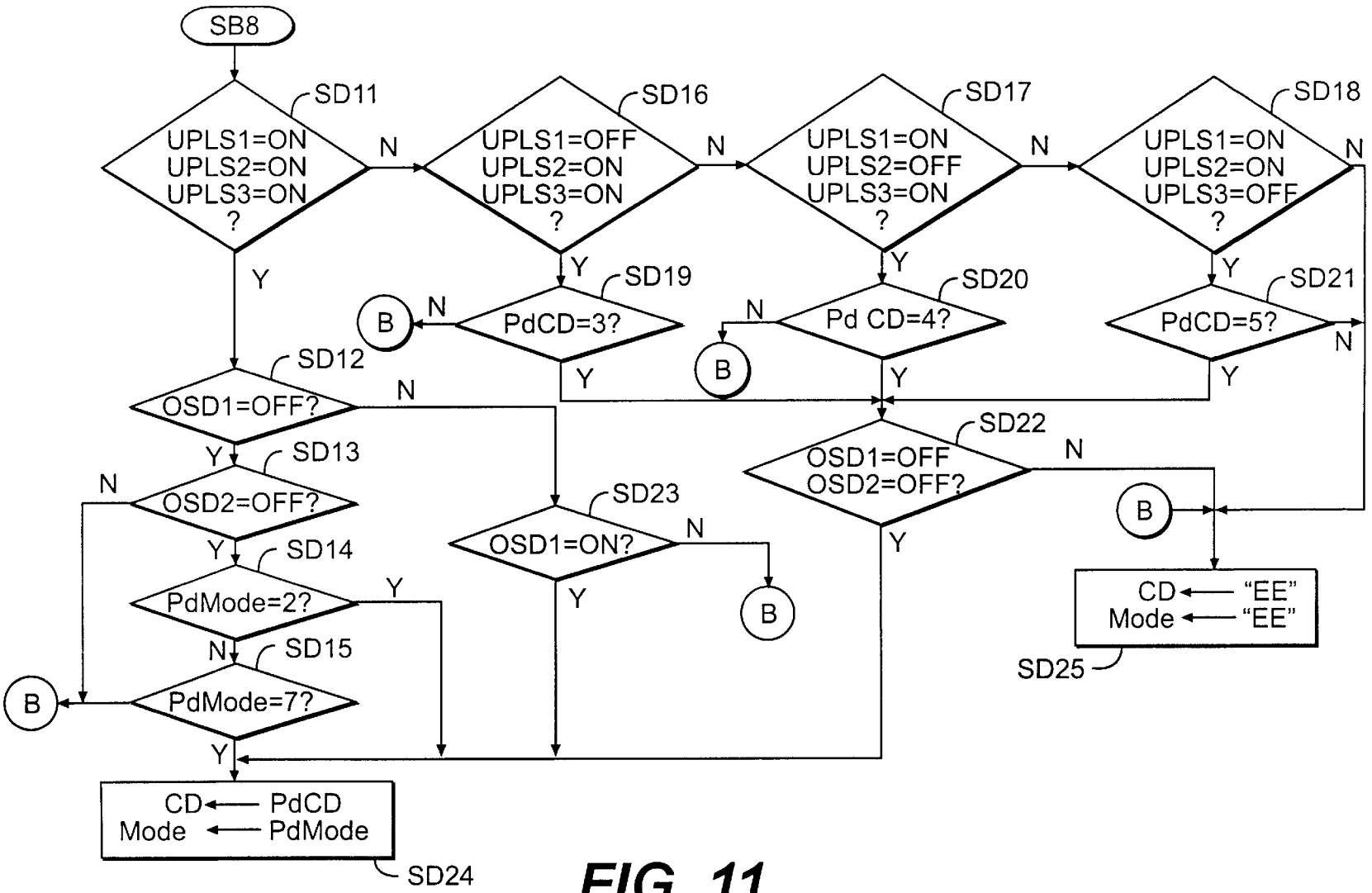
FIG. 11 is a flowchart explaining the step of determining whether or not the automatic parking operation can be resumed with the current pallets positions.

Referring now to FIG. 11, the operation of determining whether or not the automatic parking can be resumed with the current pallets position will be explained in more detail. The determining operation includes the steps of:

(a) detecting the case that the limit switches of the laterally moving pallets are ON when the limit switches of the lifting pallets are all ON, as the case that an automatic parking operation can be resumed continuously (SD11, SD12, and SD23);

(b) detecting the case that the backup data of PdNode is 2 or 7 when the limit switches of the laterally moving pallets are OFF and the limit switches of the lifting pallets are all ON, as the case that an automatic parking operation can be resumed (SD11–SD15);

(c) detecting the case that a detected pallet number is identical to one retrieved from the RAM when at least one of the limit switches is OFF, and the limit switches of the laterally moving pallets are all OFF, as the case that an automatic parking operation can be resumed (SD16–SD22).

(d) when not detecting any of those cases above, generating an error signal to make the system not operable.

The advantages and effects of the system according to the present invention constructed as above will be explained in detail with reference to FIGS. 4–11.

Referring to FIGS. 4–6, if the system operator or the vehicle driver enters the pallet number by manipulating the manipulation panel 101 of the manipulation means 100, the CPU 201 of the control means 200 controls the pallet driving means 320 to move the called pallets. At this time, the CPU 201 determines the pallet operation status upon receipt of output signals of the limit switches 3*a*–3*c*, 4*a*–4*c*, 7*a*, 7*b* installed on the pallets.

Referring now to FIG. 7, the function of the control means 200 is explained in detail. The addresses A0–A15 for addressing the memory outputted from the CPU 201 are divided into two to be temporarily stored in the two latches 202A, 202B, and then used to assign the addresses of the upper level and the lower level ROMs 204U, 204L, and of the upper level and lower level RAMs 205U, 205L, the lower level data D0–D7 outputted from the data buffer 203A are provided to the lower level ROM 204L and the lower level RAM 205L, and the upper level data D8–D15 transmitted from the data buffer 203B are provided to the upper level ROM 204U and the upper level RAM 205U. In particular, the lower level RAM 205L is also connected to the backup battery means 206 so that the RAM 205L can keep the backup data.

The output data from a plurality of the limit switches are supplied to the CPU 201 via the input/output boards 208A–208N and the interface unit 207, and the data outputted from the CPU 201 as well as addresses for those data are transmitted to the plurality of the input/output boards 208A–208N.

Hereinafter, the operation of the control apparatus for a parking system according to the embodiment of the present invention will be explained in more detail with reference to FIGS. 8–11.

First of all, if the safety related problem is determined not existing (when determined NO at step of SA2), after the power switch is turned on (SA1), the safety confirmation button is pressed down by the system operator or the vehicle driver at step of SA4. The system operator or the vehicle driver presses down a desired pallet button which is available and then the pallet call button as well, at step of SA5. The data indicative of the called pallet number CD is stored at step of SA6, and then the CD is stored as a backup data (in the flowchart, denoted as PdCD) indicative of the pallet number in the certain address at step of SA7.

After completion of a series of the above described steps, the operation for storing or retrieving the motor vehicle is executed. Here, the operation is comprised of 8 modes. The operation status of the modes are shown in Tables 1, 2 and 3.

TABLE 1 the logic table when the lifting pallet 2c is called.

| MODE | OPERATION STATUS | OPERATION STATUS DETECTING SIGNALS |
|---|---|---|
| 0 | REFERENCE POSITION | UPLS1 = ON, UPLS2 = ON, UPLS3 = ON, DNLS1 = OFF, DNLS2 = OFF, DNLS3 = OFF, ODS = ON, ODS2 = ON |
| 1 | STAND BY FOR SECONDS BEFORE THE OPERATION | UPLS1 = ON, UPLS2 = ON, UPLS3 = ON, DNLS1 = OFF, DNLS2 = OFF, DNLS3 = OFF, ODS = ON, ODS2 = ON |
| 2 | LATERALLY MOVING PALLETS MOVE IN THE RIGHT DIRECTION | UPLSI = ON, UPLS2 = ON, UPLS3 = ON, DNLS1 = OFF, DNLS2 = OFF, DNLS3 = OFF, ODS = OFF, ODS2 = OFF |
| 3 | LEFT SIDE LIFTING PALLET MOVES DOWN | UPLS1 = OFF, UPLS2 = ON, UPLS3 = ON, DNLS1 = OFF, DNLS2 = OFF, DNLS3 = OFF, ODSI = OFF, ODS2 = OFF |
| 4 | STAND BY FOR STORING A MOTOR VEHICLE | UPLS1 = OFF, UPLS2 = ON, UPLS3 = ON, DNLS1 = ON, DNLS2 = OFF, DNLS3 = OFF, ODSI = OFF, ODS2 = OFF |
| 5 | STAND BY FOR SECONDS BEFORE THE OPERATION | UPLS1 = OFF, UPLS2 = ON, UPLS3 = ON, DNLS1 = ON, DNLS2 = OFF, DNLS3 = OFF, ODSI = OFF, ODS2 = OFF |
| 6 | LEFT SIDE LIFTING PALLET MOVES UP | UPLS1 = OFF, UPLS2 = ON, UPLS3 = ON, DNLS1 = OFF, DNLS2 = OFF, DNLS3 = OFF, ODSI = OFF, ODS2 = OFF |
| 7 | LATERALLY MOVING PALLETS MOVE IN THE LEFT DIRECTION | UPLS1 = ON, UPLS2 = ON, UPLS3 = ON, DNLS1 = OFF, DNLS2 = OFF, DNLS3 = OFF, ODSI = OFF, ODS2 = OFF |

TABLE 2 the logic table when the lifting pallet 2d is called.

| MODE | OPERATION STATUS | OPERATION STATUS DETECTING SIGNALS |
|---|---|---|
| 0 | REFERENCE POSITION | UPLS1 = ON, UPLS2 = ON, UPLS3 = ON, DNLS1 = OFF, DNLS2 = OFF, DNLS3 = OFF, ODS = ON, ODS2 = ON |
| 1 | STAND BY FOR SECONDS BEFORE THE OPERATION | UPLS1 = ON, UPLS2 = ON, UPLS3 = ON, DNLS1 = OFF, DNLS2 = OFF, DNLS3 = OFF, ODS = ON, ODS2 = ON |
| 2 | LATERALLY MOVING PALLETS MOVE IN THE RIGHT/LEFT DIRECTION | UPLS1 = ON, UPLS2 = ON, UPLS3 = ON, DNLS1 = OFF, DNLS2 = OFF, DNLS3 = OFF, ODS = OFF, ODS2 = OFF |

TABLE 2-continued the logic table when the lifting pallet 2d is called.

| MODE | OPERATION STATUS | OPERATION STATUS DETECTING SIGNALS |
|---|---|---|
| 3 | CENTRALR LIFTING PALLET MOVES DOWN | UPLS1 = ON, UPLS2 = OFF, UPLS3 = ON, DNLS1 = OFF, DNLS2 = OFF, DNLS3 = OFF, ODS = OFF, ODS2 = OFF |
| 4 | STAND BY FOR STORING A MOTOR VEHICLE | UPLS1 = ON, UPLS2 = OFF, UPLS3 = ON, DNLS1 = OFF, DNLS2 = ON, DNLS3 = OFF, ODS = OFF, ODS2 = OFF |
| 5 | STAND BY FOR SECONDS BEFORE THE OPERATION | UPLS1 = ON, UPLS2 = OFF, UPLS3 = ON, DNLS1 = OFF, DNLS2 = ON, DNLS3 = OFF, ODS = OFF, ODS2 = OFF |
| 6 | CENTRAL LIFTING PALLET MOVES UP | UPLS1 = ON, UPLS2 = OFF, UPLS3 = ON, DNLS1 = OFF, DNLS2 = OFF, DNLS3 = OFF, ODS = OFF, ODS2 = OFF |
| 7 | LATERALLY MOVING PALLETS MOVE IN THE LEFT/RIGHT DIRECTION | UPLS1 = ON, UPLS2 = ON, UPLS3 = ON, DNLS1 = OFF, DNLS2 = OFF, DNLS3 = OFF, ODS = OFF, ODS2 = OFF |

TABLE 3 the logic table when the lifting pallet 2e is called.

| MODE | OPERATION STATUS | OPERATION STATUS DETECTING SIGNALS |
|---|---|---|
| 0 | REFERENCE POSITION | UPLS1 = ON, UPLS2 = ON, UPLS3 = ON, DNLS1 = OFF, DNLS2 = OFF, DNLS3 = OFF, ODS = ON, ODS2 = ON |
| 1 | STAND BY FOR SECONDS BEFORE THE OPERATION | UPLS1 = ON, UPLS2 = ON, UPLS3 = ON, DNLS1 = OFF, DNLS2 = OFF, DNLS3 = OFF, ODS = ON, ODS2 = ON |
| 2 | LATERALLY MOVING PALLETS MOVE IN THE LEFT DIRECTION | UPLS1 = ON, UPLS2 = ON, UPLS3 = ON, DNLS1 = OFF, DNLS2 = OFF, DNLS3 = OFF, ODS = OFF, ODS2 = OFF |
| 3 | RIGHT SIDE LIFTING PALLET MOVES DOWN | UPLS1 = ON, UPLS2 = ON, UPLS3 = OFF, DNLS1 = OFF, DNLS2 = OFF, DNLS3 = OFF, ODS = OFF, ODS2 = OFF |
| 4 | STAND BY FOR STORING A MOTOR VEHICLE | UPLS1 = ON, UPLS2 = ON, UPLS3 = OFF, DNLS1 = OFF, DNLS2 = OFF, DNLS3 = ON, ODS = OFF, ODS2 = OFF |
| 5 | STAND BY FOR SECONDS BEFORE THE OPERATION | UPLS1 = ON, UPLS2 = ON, UPLS3 = OFF, DNLS1 = OFF, DNLS2 = OFF, DNLS3 = ON, ODS = OFF, ODS2 = OFF |
| 6 | RIGHT SIDE LIFTING PALLET MOVES UP | UPLS1 = ON, UPLS2 = ON, UPLS3 = OFF, DNLS1 = OFF, DNLS2 = OFF, DNLS3 = OFF, ODS = OFF, ODS2 = OFF |

TABLE 3-continued the logic table when the lifting pallet 2e is called.

| MODE | OPERATION STATUS | OPERATION STATUS DETECTING SIGNALS |
|---|---|---|
| 7 | LATERALLY MOVING PALLETS MOVE IN THE RIGHT DIRECTION | UPLS1 = ON, UPLS2 = ON, UPLS3 = ON, DNLS1 = OFF, DNLS2 = OFF, DNLS3 = OFF, ODS = OFF, ODS2 = OFF |

Figure 2A:
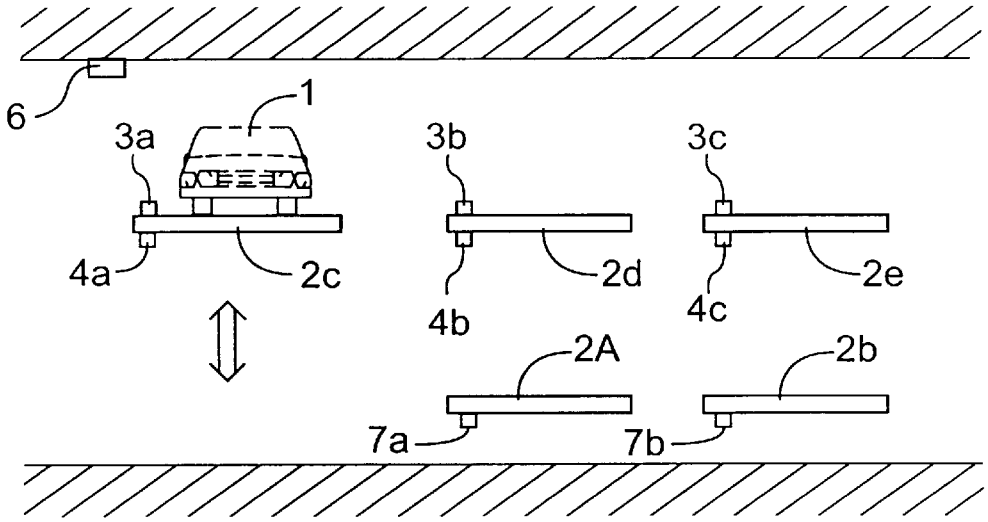
FIG. 2A CONVENTIONAL ART
FIGS. 2A–2C are schematic diagrams explaining the movement of the pallets in the system of FIG. 1.
Figure 2B:
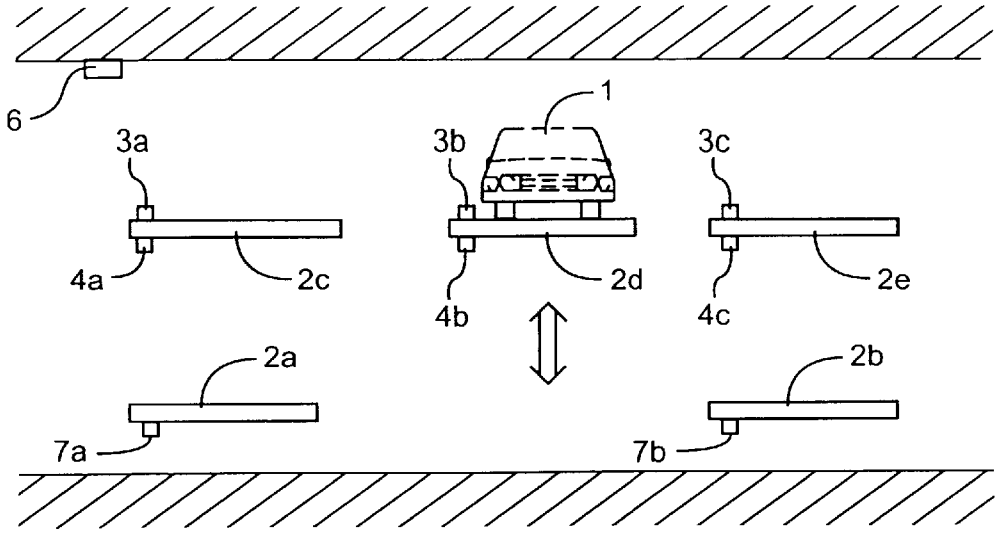
FIG. 2B CONVENTIONAL ART
Figure 2C:
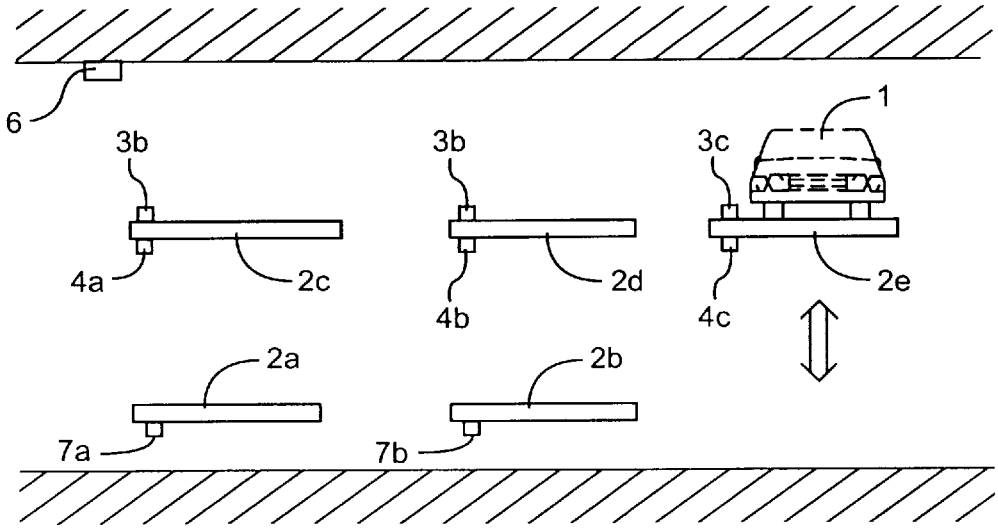
FIG. 2C CONVENTIONAL ART
Figure 3:
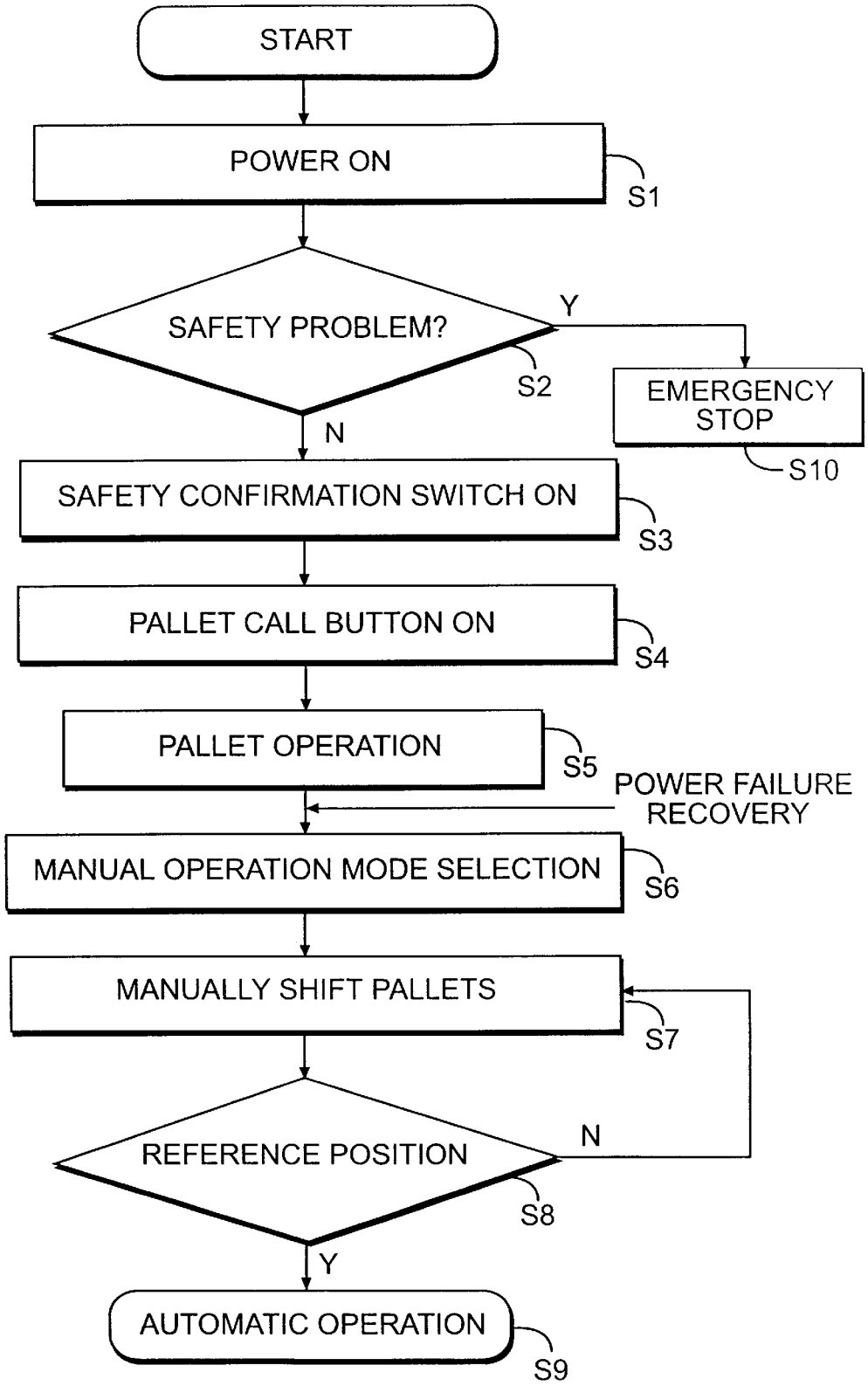
FIG. 3 CONVENTIONAL ART
FIG. 3 is a flowchart explaining the operation of the conventional vertically and laterally moving type parking system when a power failure occurs.

The operation is explained, in case that for example, the system operator or the vehicle driver called the left side lifting pallet 2*c* in the parking installation in which there are three lifting pallets 2*c*–2*e* on the upper level column and two laterally moving pallets 2*a*, 2*b* on the ground-level floor. In mode 0, the pallets are in their reference positions as shown in the FIG. 1. In mode 1, the pallets are in a stand-by condition for 3 seconds. In mode 2, the laterally moving pallets 2*a*, 2*b* are moved in the right direction such that the pallets 2*a*, 2*b* are positioned below lifting pallets 2*d*, 2*e* on the upper level column, respectively, as shown in FIG. 2. In mode 3, the lifting pallet 2*c* located in the left side on the upper level column is moved down and located in the left side on the ground-level floor, such that the motor vehicle can be retrieved therefrom. In mode 4, the pallets are in the stand-by condition for storing a motor vehicle. In mode 5, the pallets are still in the stand-by condition for another 3 seconds. In mode 6, the lifting pallet is operated opposite to as in mode 3, in another word, the lifting pallet whose reference position is on the upper level column and which is currently located on the ground-level floor is moved up. In mode 7, the pallets 2*a*, 2*b* are operated opposite to as in mode 2, in another word, the pallets are moved in the left direction such that they are in their reference positions as shown in FIG. 1.

The above described 8 modes are produced in such a manner that the operation status determining means 201C of the CPU 201 determines the operation status of the plurality of pallets by checking a plurality of operation status detecting signals.

The modes are generated each time of operation of the pallets, and its number is increased by 1 at each time when the operation of the pallets is changed until the mode number finally cycles to 0 from 7. The generated mode numbers (Mode; from mode 0 to mode 7) are stored as the PdMode in the RAM 205L which is also connected to the backup battery means 206 at step of SA10.

The data stored in the way described above is used when a power failure is recovered after a power failure occurs.

If a power failure occurs during the operation of storing or retrieving a motor vehicle as described above, and then a power failure is recovered (when determined YES at step of SB1), the CPU 201 sets the addresses of RAMs 205U, 205L with the initial values, causing the values at the certain address to be all set to 0 so that the preparation for reading that operation status detecting signals is made. The data indicative of the operation status of the plurality of the pallets (operation status detecting signals; UPLS1, UPLS2, UPLS3, DNLS1, DNLS2, DNLS3, ODS1, ODS2) is detected by the operation status detecting means 310, at step of SB3.

The CPU thereafter reads out the addresses at which the data PdCD indicative of the pallet number is stored, and the PdMode indicative of the operation status of the pallet is stored, respectively, at step of SB4.

Then, they are confirmed at step of SB5. If it is determined that the two data values of PdCD and PdMode are all 0 (when determined YES in step of SB5), the operation status detecting signal is checked again at step of SB6. If the value of the operation status detecting signal is determined to indicate the fact that the pallet is in the reference position or in the stand-by condition before the start of the initial operation (when determined YES at step of SB6), the called the pallet number CD and the mode number are reset with 0 at step of SB7. If the safety confirmation signal from the safety confirmation button is transmitted to the CPU of the control means at step of SB12, the automatic parking operation is resumed.

If the two data values of PdCD and PdMode are not 0 (when determined NO at step of SB5), the control means recognizes the fact that a power failure occurs during the operation of the moving pallets, and controls to make the determination whether or not the backup data is equal to the data indicative of the current pallet operation status transmitted from the operation status detecting means 310, at step of SB8. As a result, if it is determined that the backup data is not equal to the incoming data (when determined YES at step of SB9, or when determined NO at step of SB6), the control means generates and displays the system error message in the display panel, and then waits for any input data from the input means by the system operator or the vehicle driver in the stand-by condition, at step of SB11. However, if it is determined that the backup data is equal to the incoming data (when determined NO at step of SB9), the backup data of PdCD and PdMode are changed back to CD and Mode, respectively, at step of SB10, so that the automatic parking operation can be resumed upon receipt of the safety confirmation signal from the safety confirmation button.

Referring now to FIGS. 10 and 11, at step SB8 of comparing a backup data with the incoming data indicative of the current operation status, if it is determined that the output signals from the limit switches are all ON (when determined YES at step of SD11) as a result of checking all of the output signals from the limit switches installed on the lifting pallets at step of SD11, the output signals of the limit switches on the laterally moving pallets are checked, respectively, at step of SD12, SD23. If it is determined that the output signals of the limit switches are all ON (when determined YES at step of SD23), the status is determined to be resuming the automatic parking operation therefrom.

If it is detected that one of the output signals from one of the limit switch of the lifting pallet is OFF (when determined YES at step of SD16, or SD17, or SD18), the movement of the laterally moving pallets are checked out, at step of SD22. If it is detected that the output signals of the limit switches of the laterally moving pallets are all OFF (when determined YES at step of SD22), it is determined that the automatic parking operation can be resumed in this case.

Further, at step SB8, the output signals from the limit switches of the lifting pallets are checked at step of SD11, and the output signals from the limit switches of the laterally moving pallets are checked at step of SD12, and SD13. At step of SD11, SD12, and SD13, if it is detected that the limit switches of the lifting pallets are all ON (when determined YES at step of SD11), and the limit switches of the laterally moving pallets are all OFF (when determined YES at step of SD13), and the mode number Mode is 2 or 7, it is determined that the automatic parking operation can be resumed there from.

If it is detected that the automatic parking operation can be resumed at the above step, the PdCD and the PdMode are changed back to the CD and Mode, respectively. The CD and the Mode are displayed on the display window, and the automatic parking operation can be resumed upon receipt of the safety confirmation signal from the safety confirmation button 102. Except those cases described above, the error signals are changed back to the CD and Mode, at step of SD25, so that the error message is displayed on the display window when the automatic parking operation cannot be resumed.

In the parking system according to the present invention, the data required to resume the automatic parking operation is stored in the RAM to which the backup battery power is supplied when the power failure occurs, and are retrieved to be used so as to continuously resume the automatic parking operation when the power failure is recovered, thereby reducing the time at the stand-by condition while the operation for storing or retrieving a motor vehicle is processing, and minimizes or eliminates troublesome labor required to manually resume the parking operation as in the conventional parking system, resulting in that the operation efficiency of the parking system is eventually improved.

What is claimed is:

1. A control apparatus for a motor vehicle parking system having a plurality of laterally moving pallets located on a ground-level floor, a plurality of lifting pallets located on an upper level column and whose number is at least one more than the number of the laterally moving pallets, a driving unit installed on each of the pallets supplying a driving force to move the pallets, and a control unit controlling the driving unit, the control apparatus comprising:

a parking state backup unit storing both data indicating the identification of the lifting pallet called by the control unit during automatic parking operation and data indicating the operation status of the pallets caused by an operation of the lifting pallet; and an automatic parking resuming unit resuming the automatic parking operation by detecting the data indicating a current parking state of the system when power is recovered after a failure by comparing between the data stored in the parking state backup unit and data indicating the current parking state.

2. The control apparatus as defined in claim 1, wherein the parking state backup unit comprises a RAM connected to a backup battery unit.

3. A control apparatus for a motor vehicle parking system having a plurality of laterally moving pallets located on a ground-level floor, a plurality of lifting pallets located on an upper level column and whose number is at least one more than the number of the laterally moving pallets, and a driving unit installed on each of the pallets for supplying a driving force to shift move pallets, the control apparatus comprising:

a manipulation unit having a pallet number selection unit selecting the number of the lifting pallet to be called for storage or retrieval, and outputting a corresponding pallet number signal when the pallet number is selected by the pallet number selection unit;

operation status detecting unit installed on the lifting pallets and on the laterally moving pallets detecting the operation status of the pallets to output a detected operation status signal;

a control unit storing pallet number data defined by the pallet number signal inputted from the manipulation unit and storing pallet operation status data defined by the pallet operation status signal inputted from the operation status detecting unit, the control unit outputting both a first drive signal driving the lifting pallet corresponding to the pallet number signal to move the lifting pallets up or down and a second drive signal driving the laterally moving pallets to provide a space for the lifting pallet to move down without a collision with the laterally moving pallets to the driving unit of the lifting pallet assigned by the pallet number signal and to the driving unit of the laterally moving pallets; respectively, said control unit controlling automatic resumption of a parking operation after recovering from a power failure;

a direct current power supply unit supplying to the control unit a direct current power source; and a backup battery unit connected to the normal alternating current power source recharging with the direct current power source converted from the alternating current power source during normal operation and supplying a backup power source to the control means when the power failure occurs.

4. The control apparatus as defined in claim 3, wherein the control means comprises:

a first memory unit storing the data indicating the selected pallet number;

an operation status determining unit determining an operation status of the pallets;

a second memory unit storing the operation status data outputted from the operation status determining unit according to a movement of the lifting pallet which is called:

a first comparator unit reading out the pallet number data from the first memory unit when the power is supplied from the direct current power supply means, the first comparator unit comparing the read-out data with data indicating identification numbers assigned for the lifting and laterally moving pallets output a corresponding comparison signal;

a second comparator unit reading out the pre-power failure pallet operation status data from the second memory means when the power is supplied from the direct current power supply means, the second comparator unit comparing the read-out data with data indicating current operation status data defined by current operation status signals; and a controller for outputting the drive signals of the lifting pallets only when the two data values are equal to each other as a result of comparison performed by the first comparator means by the second comparator means, respectively.

5. The control apparatus as defined in claim 3, wherein the backup battery unit is connected to the first memory unit and the second memory unit.

6. A control method for a motor vehicle parking system having a plurality of laterally moving pallets located on a ground-level floor and a plurality of lifting pallets located on an upper level column, the control method comprising:

(a) storing a parking state including a pallet identifier of the called pallet and an operation status of the called pallet; and (b) automatically resuming a parking operation if the condition meets the requirement to resume the automatic parking operation as a result of comparing the stored parking state with a current parking state of the system when power is restored after a failure.

7. The control method as defined in claim 6, wherein the parking state storing step comprises the substeps of:

(a) storing a corresponding pallet identifier signal, generated when a system operator or vehicle driver calls a pallet when it is determined that a safety related problem does not exist as a result of checking the safety of the parking installation in a normal power supply condition, as a backup pallet identifier data in a RAM; and (b) storing corresponding pallet operation status signals, which are mode identifiers produced by the CPU whenever the called pallet operates, as a backup pallet operation status data in the RAM, and performing the automatic parking operation when the pallet is on its reference position.

8. The control method as defined in claim 6, wherein the automatic parking operation-resuming step comprises the substeps of:

(a) determining whether or not the automatic parking operation can be resumed by comparing a current operation status of the pallets in the system and the pallet identifier with the pallet operation status and a pallet identifier backup data from the backup unit, when the power is restored; and (b) controlling the automatic parking operation upon receipt of a safety confirmation signal if it is determined that automatic parking operation can be resumed and providing an error signal if it is determined that the automatic parking operation cannot be resumed.

9. The control method as defined in claim 6, wherein the automatic parking operation resuming step determines that the automatic parking operation can be resumed in case that when only one of the lifting pallets is out of its reference position, and the detected out of reference pallet number is identical to the restored pallet number from the backup unit and the laterally moving pallets are detected to be out of their reference positions.

10. The control method as defined in claim 6, wherein the automatic parking operation resuming step detects that the automatic parking operation can be resumed in case that the laterally moving pallets and the lifting pallets are in their reference positions.

11. The control method as defined in claim 6, wherein the automatic parking operation resuming step detects that the automatic parking operation can be resumed in case that the laterally moving pallets and the lifting pallets system are all ON as a result of checking output signals from the upper limit are in their reference positions.

12. An automatic parking resumption apparatus for a motor vehicle parking system, comprising:

a parking state backup unit storing parking state of an automatic parking operation, said parking state including a pallet identifier of a pallet and an operation status of the pallet; and an automatic operation detecting unit determining if parking operation can be automatically resumed, when power is restored after a failure, by comparing a current parking state of said parking system and said parking state of said automatic parking operation stored in said parking state backup unit.

13. The apparatus of claim 12, wherein said parking state backup unit is connected to a backup power source.

14. An automatic motor vehicle parking system, comprising:

a plurality of laterally moving pallets;

a plurality of vertically moving pallets; and a control unit controlling a parking operation including controlling said pluralities of laterally and vertically moving pallets, said control unit storing a parking state including a pallet identifier and an operation state of a pallet as operations are carried out, said control unit automatically resuming said parking operation, when power is restored after a failure, if said control unit determines that said parking operation can be resumed by comparing a current parking state of the parking system to said stored parking state of said parking operation.

15. The system of claim 14, wherein a number of said vertically moving pallets is at least one greater than a number of said laterally moving pallets.

16. The system of claim 14, wherein said control unit further comprises:

a plurality of ROMs containing programs to perform said parking operation and to perform automatic resumption of said parking operation after recovery from a power failure;

a plurality of RAMs containing said parking state of said parking operation; and a central processing unit controlling the storage of said parking state of said parking operation and controlling an execution of said parking operation including said automatic resumption of parking operation after recovery from said power failure.

17. A method to control motor vehicle parking system, comprising:

storing a parking state of a parking operation of said parking system as said parking operation is being carried out;

comparing a current parking state of said parking system with said stored parking state of said parking operation when power is restored after a failure; and automatically resuming said parking operation, after recovery from said power failure, if the comparing step determines that said parking operation can be resumed.

18. The method of claim 17, further comprising displaying error message, after recovery from said power failure, if the comparing step determines that said parking operation cannot be resumed.

* * * * *